US007581269B2

(12) United States Patent
Chen et al.

(10) Patent No.: US 7,581,269 B2
(45) Date of Patent: Sep. 1, 2009

(54) CHANGING TABLE FOR PLAYARD

(75) Inventors: Shun-Min Chen, Taipei (TW); Jianqun Li, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 86 days.

(21) Appl. No.: 11/717,117

(22) Filed: Mar. 13, 2007

(65) Prior Publication Data

US 2008/0098530 A1 May 1, 2008

(30) Foreign Application Priority Data

Oct. 27, 2006 (CN) ..... 2006 2 0149903 U

(51) Int. Cl.
*A47D 5/00* (2006.01)
*A47D 7/04* (2006.01)
*A47D 13/06* (2006.01)

(52) U.S. Cl. ..... 5/655; 5/93.1

(58) Field of Classification Search ..... 5/655, 5/93.1, 98.1, 99.1, 507.1, 503.1, 658
See application file for complete search history.

(56) References Cited

U.S. PATENT DOCUMENTS 5,918,329 A * 7/1999 Huang ..... 5/93.1
6,173,462 B1 * 1/2001 Huang et al. ..... 5/655
6,332,231 B1 * 12/2001 Wang ..... 5/507.1
6,543,070 B2 * 4/2003 Longenecker et al. ..... 5/93.1
6,948,197 B1 * 9/2005 Chen ..... 5/93.1
6,952,849 B2 * 10/2005 Pacella ..... 5/658
7,263,729 B2 * 9/2007 Paesang et al. ..... 5/98.1
7,418,745 B2 * 9/2008 Paesang et al. ..... 5/98.1
2002/0166169 A1 * 11/2002 Longenecker et al. ..... 5/93.1
2004/0187212 A1 * 9/2004 Pacella ..... 5/503.1
2006/0080776 A1 * 4/2006 Clapper et al. ..... 5/93.1
2006/0130237 A1 * 6/2006 Clapper et al. ..... 5/655
2006/0253980 A1 * 11/2006 Paesang et al. ..... 5/99.1
2008/0000857 A1 * 1/2008 Chen et al. ..... 211/88.01
2008/0034506 A1 * 2/2008 Chen et al. ..... 5/655
2008/0098530 A1 * 5/2008 Chen et al. ..... 5/655
2009/0113622 A1 * 5/2009 Hartenstine ..... 5/2.1
2009/0113624 A1 * 5/2009 Tuckey ..... 5/93.1

* cited by examiner

*Primary Examiner*—Robert G Santos
(74) *Attorney, Agent, or Firm*—Bacon & Thomas, PLLC

(57) ABSTRACT

A changing table for a playard has an upper end rail member, a pair of upper side rail members, and a pair of comer pieces connected to the upper end rail member and upper side rail members respectively. The changing table is mounted on top of the playard, having a first rail disposed on top of the upper end rail member a second rail opposed to the first rail, and a pair of side rails respectively connected to the first and second rails. Each respective side rail has a first portion connected to the first rail, and a second portion connected to the second rail. The first portion is connected to the second portion at an angle so that a portion of the side rail is disposed below the upper side rail members of the playard.

5 Claims, 4 Drawing Sheets

CHANGING TABLE FOR PLAYARD

FIELD OF THE INVENTION

The present invention relates generally to a changing table for a playard which is simple and easy to operate, and may preclude the child caregiver's hands from crush injury when the changing table is accidentally collapsed or pressed down, which frequently happens in the playard of the known type. The present invention further provides an organizer for storing diaper changing supplies.

BACKGROUND OF THE INVENTION

Changing tables for playards are well known in the prior art. A parent or caretaker can change a child's diaper or perform other baby caretaking tasks on a changing table that can be mounted to the top of the playard. The changing table, which is generally rectangular in shape, can be supported on its sides by upper frame supports of the playard. After the child's diaper has been changed, the changing table can be removed from the playard, or in some applications, can be swung about an upper frame support of the playard to a storage position exterior of the playard. In this respect, the parent or caretaker can lift one side of the changing table and can swing the changing table about the upper frame support to its storage position at an exterior side of the playard. The changing table can then rest in its storage position exterior of the playard.

An exemplary apparatus in the prior art is described in U.S. Pat. No. 6,543,070 incorporated herein by reference. In this conventional changing table, the folding arms 14, 16 are designed to pivot about the pivot joint 12, and thus the changing table can be swung about the upper frame support of the playard to its storage position. However, this changing table has a disadvantage in that, when the baby is placed on the changing table, a rolling movement of the baby may accidentally move the folding arms 14, 16 to pivot about the pivot joint 12, causing the folding arms 14, 16 to collapse and harm the baby.

U.S. Pat. No. 6,952,849 disclosed an organizer for diaper changing supplies, such as diapers, disposable wet wipes, and baby powder. Such organizer is attached to the playyard simply by suspending, which is insecure and may fall off easily.

Furthermore, in conventional playyard, the changing table is located above the playyard and thus a gap is formed therebetween. Such a gap may accidentally harm the child caregiver's fingers and trap the child's head, creating a potentially hazardous area.

SUMMARY OF THE INVENTION

The main objective of the present invention is to provide a changing table for a playard which tends to obviate the aforementioned problem. The changing table according to the present invention enables the child caretakers to conveniently move the changing table between an operation position and a storage position. The present invention may overcome the defects of the conventional changing tables, such as accidental collapse and harm to the child and caregiver. Furthermore, the changing table may also connect an organizer in the present invention. When the changing table is in the storage position, the user could use the organizer without any interference.

A changing table for a playard is provided. The changing table comprises an upper end rail member, a pair of upper side rail members, and a pair of comer pieces connected to the upper end rail member and upper side rail members respectively. The changing table is mounted on top of the playard, and characterized in that: a first rail is disposed on top of the upper end rail member a second rail opposed to the first rail, and a pair of side rails are respectively connected to the first and second rails. The pair of side rails, comprises a first portion connected to the first rail, and a second portion connected to the second rail. The first portion is connected to the second portion at an angle so that a portion of the side rail is disposed below the upper side rail members of the playard.

Additional features and advantages of the present invention will be set forth in the description to follow. The objectives and other advantages of the invention will be realized and attained by the structure particularly pointed out in the written description and claims as well as the appended drawings.

BRIEF DESCRIPTION OF THE DRAWINGS

The present invention will now be described with reference to the accompanying drawings illustrating preferred embodiments, in which.

DETAILED DESCRIPTION OF THE PREFERRED EMBODIMENTS

Figure 1:
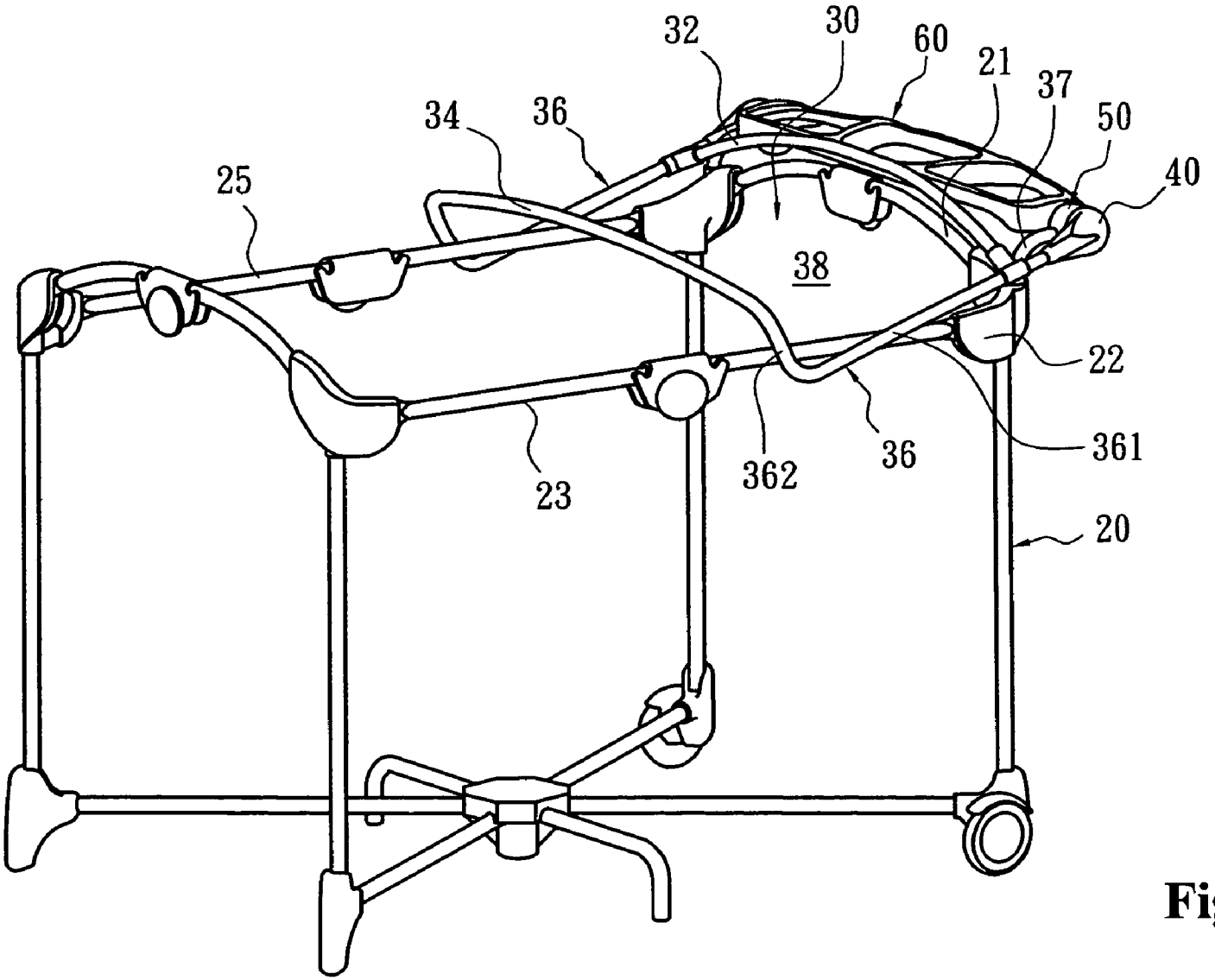
FIG. 1 is a perspective view of a playard attached with a changing table in accordance with preferred embodiment of the present invention.

Referring to the figures, wherein like numerals indicate like parts, and in particular to FIG. 1, a playard 20 is shown with a changing table 30 mounted thereto in accordance with the present invention. The playard 20 can be any conventional playard having one upper end rail member 21 and a pair of upper side rail members 23, 25. In general, the upper side rail members 23, 25 are connected to two sides of the end rail member 21 respectively through other structural members, such as legs, comer pieces 22, etc.

Changing table 30 includes first and second frames 32, 34 and a pair of side frames 36 respectively connected to the first and second frames 32, 34 to form a platform 38.

Referring to FIG. 1, the side rail 36 extends backwards a further distance from the juncture with the first frame 32 and terminates at one end which is mounted a first pivot joint 40. The first pivot joint 40 is pivotally connected to a second pivot joint 50. The first pivot joint 40 and second pivot joint 50 can be any pivot joints of the known type, and exemplary pivot joints in the prior art are described in U.S. Pat. No. 6,948,197 incorporated herein by reference. The changing table 30 is movable between an operation position and a storage position by the operation of the pivot joints.

Figure 2:
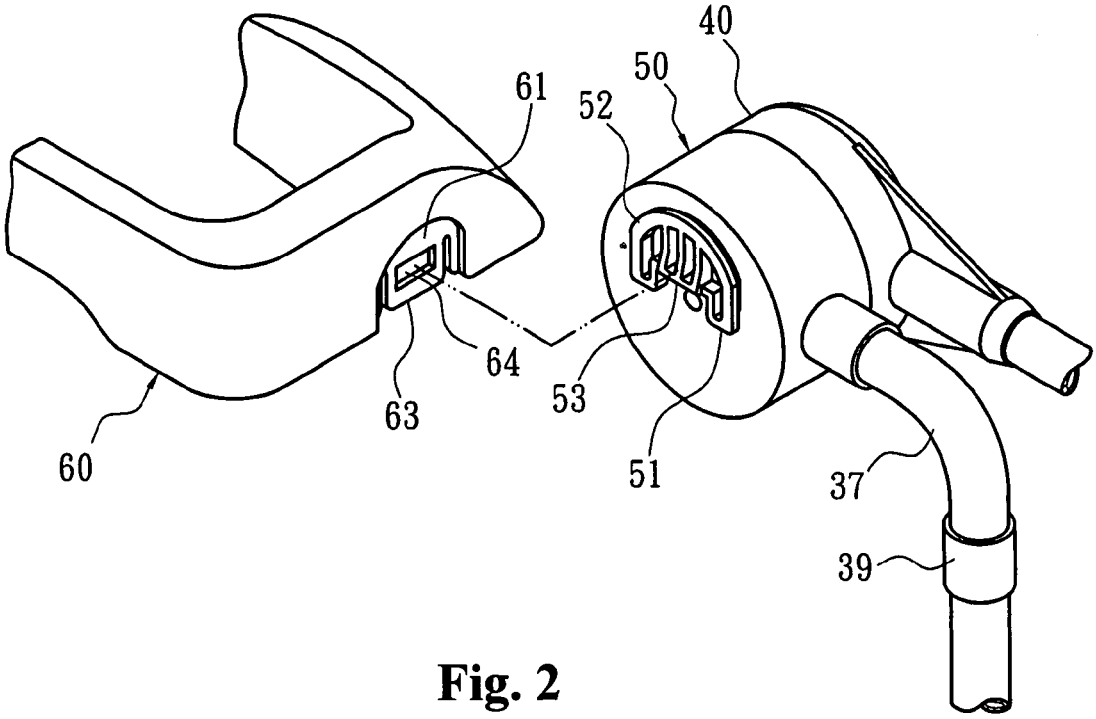
FIG. 2 is an exploded view of the pivot joint and the organizer of the changing table in accordance with preferred embodiment of the present invention.
Figure 3:
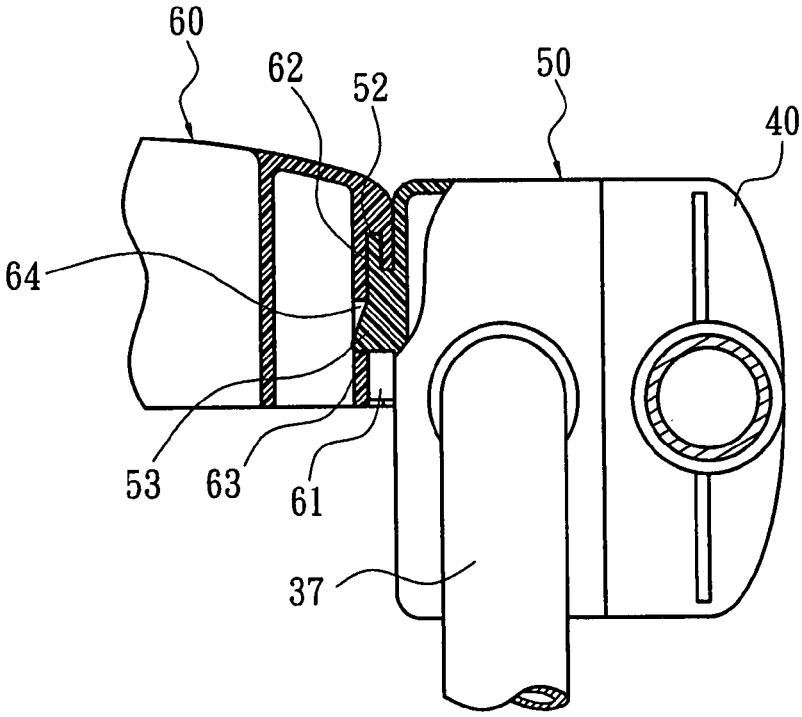
FIG. 3 is a sectional view illustrating the assembly of the pivot joint and the organizer of the changing table in accordance with preferred embodiment of the present invention.

Referring to FIGS. 2 and 3, the second pivot joint 50 includes a protruding portion 51 at one surface opposed to the surface adjoining the first pivot joint 40. The protruding portion 51 is substantially semi-circular shaped in this embodiment, and formed on the upper half portion of the surface of the second pivot joint 50.

An organizer 60 attached to the second pivot joint 50 has an indentation 61 that corresponds to the protruding portion 51 formed generally on the central portion of each of the side surfaces. The protruding portion 51 may fit into the indentation 61 so that the second pivot joint 50 is securely locked with the organizer 60.

FIG. 3 is a sectional view illustrating in detail the engagement between the protruding portion 51 of the second pivot joint 50 and the indentation 61 of the organizer 60. It is seen that the indentation 61 is depressed inwardly to form a recess and an inverted U-shaped slot 62 defines the side wall of the recess. The recess has a resilient piece 63 at the bottom end. The resilient piece 63 has an opening 64 at the center. The protruding portion 51 includes a projected flange 52 formed at the periphery, and a wedge 53 formed at the lower edge and extending transversely. To engage the second pivot joint 50 with the organizer 60, first force the projection 52 of the protruding portion 51 into the slot 62 of the indentation 61, and then exert a force to move the protruding portion 51 upwards, so that the projection 52 of the protruding portion 51 slides into the slot 62 and is locked therein. The resilient piece 63 of the indentation 61 is urged by the convex 53 and forced to flex inwards, until the convex 53 is locked in the opening 64, thereby achieving a secure engagement.

In another preferred embodiment, the protruding portion 51 and the indentation 61 is replaceable with each other. That is, the indentation 61 can be provided on the second pivot joint 50, while the protruding portion 51 can be provided on the organizer 60.

Referring to FIG. 2, the second pivot joint 50 connects a tube 37 which is removably inserted into a slot of the comer piece 22 of the playard 20, to thereby achieve a secure connection between the changing table 30 and the playard 20. The tube 37 has a retaining device 39 to position the tube 37 on the playard 20.

Referring again to FIG. 1, the side rail 36 of the changing table 30 is not horizontally disposed, but extends slantingly and downwardly below the side rail members 23, 25 of the playard 20, and then curves upwardly for a predetermined distance. The side rail 36 includes a first portion 361 connected to the first frame 32, and a second portion 362 connected to the second frame 34. The first portion 361 is connected to the second portion 362 at an angle so that a portion of the side rail 36 is disposed below the side rail members 23, 25 of the playard 20. Such an arrangement can preclude that the fingers of the child caregiver are jammed during the operation of the changing table 30, and more importantly, can prevent the child's neck from being trapped between the side rail members 23, 25 and side rail 36 of the changing table 30, and thus avoid potential smothering.

Figure 4:
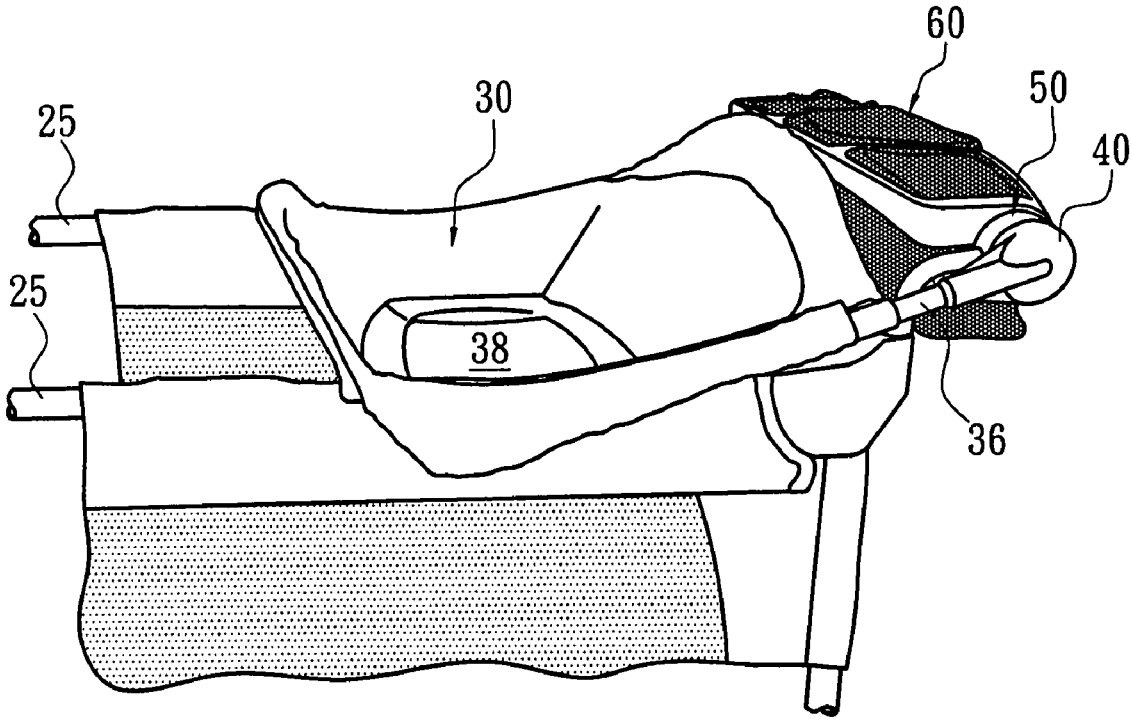
FIG. 4 is a perspective view showing the changing table in accordance with preferred embodiment of the present invention attached to a playard in the assembled state.

FIG. 4 is a perspective view showing the changing table 30 attached to a playard 20 in the assembled state. The changing table 30 includes a fabric enveloping the first frame 32, second frame 34 and side rail 36 to form the platform 38. The fabric can cover up the gap defined by the side rail 36 and side rail members 23, 25 of the playard 20, and attain the objective the present invention.

The design of the present invention enebles the changing table 30 to pivot about the organizer 60. Therefore, as the changing table 30 is moved to the storage position, platform 38 will not cover the upper side of the organizer 60 to interfere with the organizer 60. The platform 38 of the changing table 30 is moved to the side of the playard 20 and is below the organizer 60 when the changing table 30 is in the storage position. User could use the organizer 60 without any interference.

Figure 5:
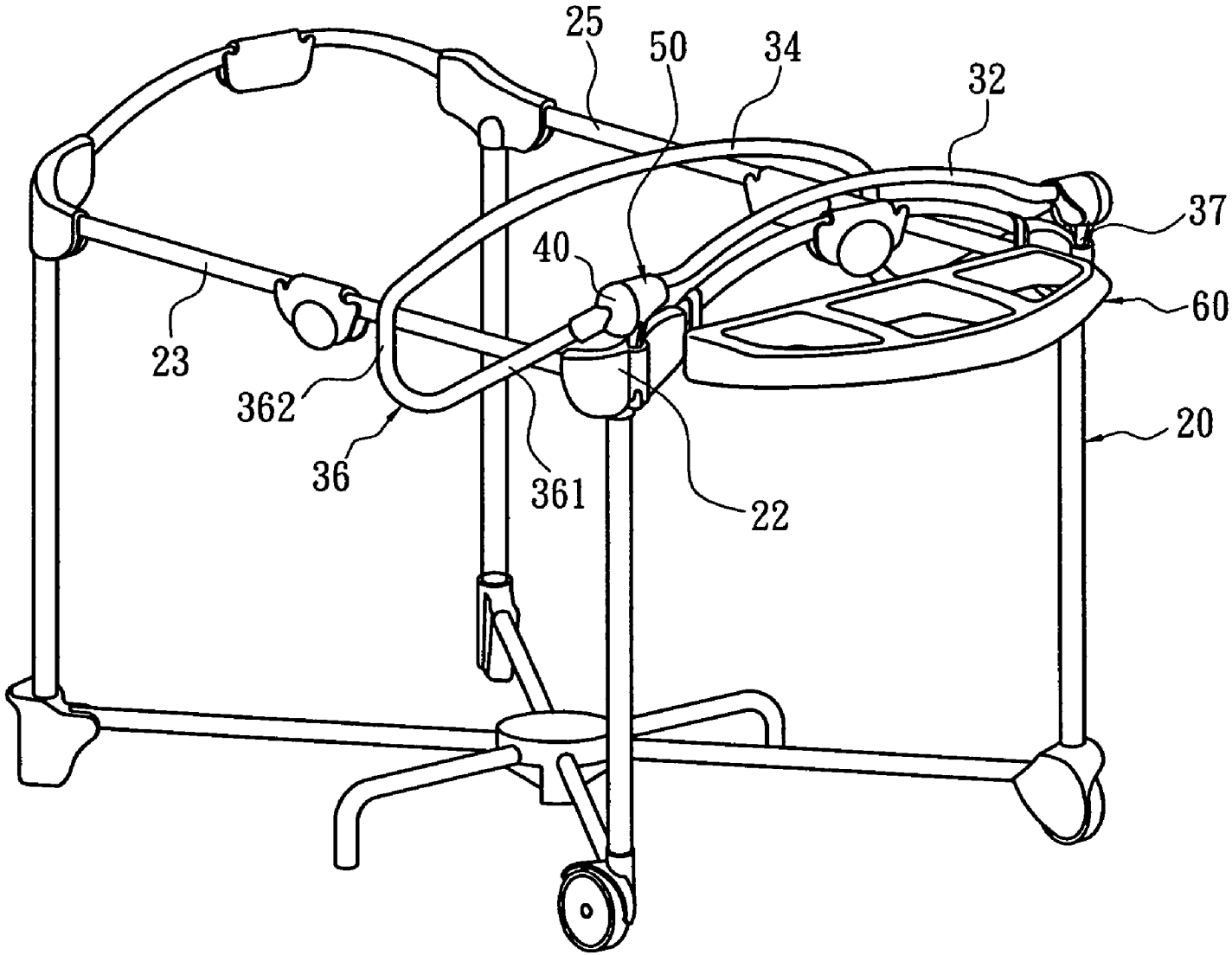
FIG. 5 is a perspective view of a playard attached with a changing table according to another preferred embodiment of the present invention.

FIG. 5 is a perspective view of a playard attached with a changing table according to another preferred embodiment of the present invention. In the figure, like numerals indicate like parts. The difference between this embodiment and the above mentioned embodiment lies in that the changing table is not attached to the organizer in this embodiment.

In this embodiment, the first pivot joint 40 and second pivot joint 50 are located between the side rail 36 and the first frame 32, the first pivot joint 40 is disposed on the side rail 36, and the second pivot joint 50 is disposed on the first frame 32. The changing table 30 can be swung to move between the operation (in-use) position and storage position by the rotation movement between the first pivot joint 40 and second pivot joint 50. The side rail 36 is not disposed horizontally, just as similar to that of the first embodiment.

The side rail 36 includes a first portion 361 connected to the first pivot joint 40, and a second portion 362 connected to the second frame 34. The first portion 361 is connected to the second portion 362 at an angle so that a portion of the side rail 36 is disposed below the side rail members 23, 25 of the playard 20.

After the fabric has been put on the changing table 30, it will cover up the gap defined by the side rail 36 and side rail members 23, 25 of the playard 20, and attain the objective the present invention.

Although the foregoing has been described in terms of presently preferred and alternate embodiments, those skilled in the art will recognize that the invention is not limited to the embodiments described. The apparatus of the present invention can be practiced with modification and alteration within the spirit and scope of the appended claims. The description is thus to be regarded as illustrative instead of limiting the present invention.

We claim:

1. A changing table for mounting on a playard comprising:

a first rail, a second rail opposed to the first rail, and a pair of side rails respectively connected to the first and second rails, wherein the first rail, the second rail, and the pair of side rails form an enclosed loop, and each side rail has one end extending a distance from a juncture with the first rail and is attached to a first pivot joint;

an organizer is positioned between the ends of the side rails and attached to second pivot joints wherein the second pivot joints are pivotally connected respectively to the first pivot joints;

a fabric connected to the first rail, second rail and side rails to form a platform, wherein the first and second pivot joints are operable to move the changing table between an operation position in which the platform is positioned above the playard, and a storage position in which the platform is positioned at a side of the playard and uncovers an upper side of the organizer.

2. The changing table according to claim 1, wherein the second pivot joint includes a first coupling device configured to engage with a second coupling device of the organizer so that the organizer is removably coupled to the changing table.

3. The changing table according to claim 1, wherein the changing table further has a pair of tubes to connect to the second pivots, respectively, and the tubes are removably inserted to a top frame of the playard.

4. The changing table according to claim 1, wherein each side rail between the first rail and the second rail comprises a first portion connected to the first rail and a second portion connected to the second rail, the first portion is non-parallelly connected to the second portion so that the fabric can cover up a gap defined by the side rails of the changing table and a top frame of the playard when the changing table is in the operation position.

5. The changing table according to claim 3, wherein each side rail between the first rail and the second rail comprises a first portion connected to the first rail, and a second portion connected to the second rail, the first portion is non-parallelly connected to the second portion so that the fabric can cover up a gap defined by the side rails of the changing table and a top frame of the playard when the changing table is in the operation position.

* * * * *